US005545447A

United States Patent [19]

DeMars

[11] Patent Number: 5,545,447

[45] Date of Patent: Aug. 13, 1996

[54] CUP HOLDER

[76] Inventor: Robert A. DeMars, 23221 Ladrillo Ave., Woodland Hills, Calif. 91367

[21] Appl. No.: 452,378

[22] Filed: May 26, 1995

[51] Int. Cl.[6] ..... B65D 25/28

[52] U.S. Cl. ..... 428/16; 215/396; 220/759; 248/311.2; 428/542.4

[58] Field of Search ..... 428/7, 16, 542.4; 215/396; 220/759; 248/311.2

[56] References Cited

U.S. PATENT DOCUMENTS

| | | | |
|---|---|---|---|
| 2,070,414 | 2/1937 | Snell | 428/131 X |
| 2,933,280 | 4/1960 | Hard | 428/16 X |
| 4,552,276 | 11/1985 | Buch | 215/396 |
| 4,654,274 | 3/1987 | DeMars | 428/16 X |
| 4,791,030 | 12/1988 | DeMars | 428/16 X |

*Primary Examiner*—Henry F. Epstein
*Attorney, Agent, or Firm*—Jack C. Munro

[57] ABSTRACT

A cup holder (10) which comprises a figurine (12) mounted on a base (22). The figurine (12) includes a pair of arms (14) with the hands (16) located in a downwardly extending position forming a pair of hook members. The hook members are to be located over the rim (30) of a cup (36) with an interlocking device (32) mounted on the cup (36) directly adjacent the bottom (34) of the cup (36) connecting with a lock hole (24) in the base (22). The figurine (12) is sufficiently deflectable so as to permit disengagement of the figurine (12) from the cup (36). When disengaged, the figurine (12) can be located internally or externally in a stacked position on the cup (36). The figurine (12) can also be mounted on the inverted cup (36) resembling a trophy.

8 Claims, 3 Drawing Sheets

CUP HOLDER

BACKGROUND OF THE INVENTION

1) Field of the Invention

The field of this invention relates to a cup holder which provides a handle for the cup when it is being used.

2) Description of the Prior Art

Cup holders in the form of handles for cups have long been known. Reference is to be had to the U.S. Pat. Nos. 4,654,274 and 4,791,030, both issued to the present inventor. Both of these prior art cup holders utilize a figurine which is to be grasped as a handle with the figurine being mounted on a base with the cup being located between the base and the figurine. The cup is to be disengagable from the figurine. The reason for the disengagement of the figurine from the cup is to provide a play toy for a child when the contents have been consumed from the cup.

Although such cup holders that utilize a figurine in conjunction with a cup have utility for people that have dexterity problems and small children, who also have small hands and thereby a dexterity problem, the primary purpose of such cup holders is as an advertising device for fast food restaurants and other similar business establishments. Figurines can be constructed in a shape that is attractive to small children so that parents will be inclined to patronize such establishments.

SUMMARY OF THE INVENTION

The structure of the present invention is directed to a cup holder which takes the form of a figurine which is mounted on a base. The figurine has a pair of arms which terminate in hands which are downwardly depending forming hook members. These hands are to be draped over the rim of a cup. An interlocking device in the form of a protuberance mounted at the bottom of the cup connects with a hole formed in the base. This securely locks together the figurine and the cup with disengagement being permitted by the figurine and base being somewhat deflectable to allow for disengagement of the protuberance from the hole. When disengaged, the figurine and the base are to be locatable in a stacked relationship relative to the cup by either locating of the base on a ledge formed on the interior sidewall of the cup directly adjacent the open top of the cup, mounted over the rim of the cup or mounted over the bottom of the cup. When the figurine is located in a stacked relationship internally with the open top of the cup or over the rim of the cup, a drinking straw may be inserted through a hole in the base for removing of liquid contents contained within the cup.

The primary objective of the present invention is to provide an attractive cup holder which not only can function as a device that facilitates consuming of a beverage from a cup but also is capable of functioning as an attractive toy to children when it is not being used as a cup holder.

Another objective of the present invention is to provide a cup holder which utilizes a figurine as a handle where the figurine can be disengaged from the cup and located in a mounted position on the cup, thereby displaying the figurine in a pronounced manner resembling in essence a trophy.

Another objective of the present invention is to permit consuming of the contents within the cup during the time the figurine is located in a stacked position on the cup.

Another objective of the present invention is to construct a cup holder which can be manufactured inexpensively and thereby sold to the ultimate consumer at an inexpensive price.

DETAILED DESCRIPTION OF THE PREFERRED EMBODIMENT

Figure 1:
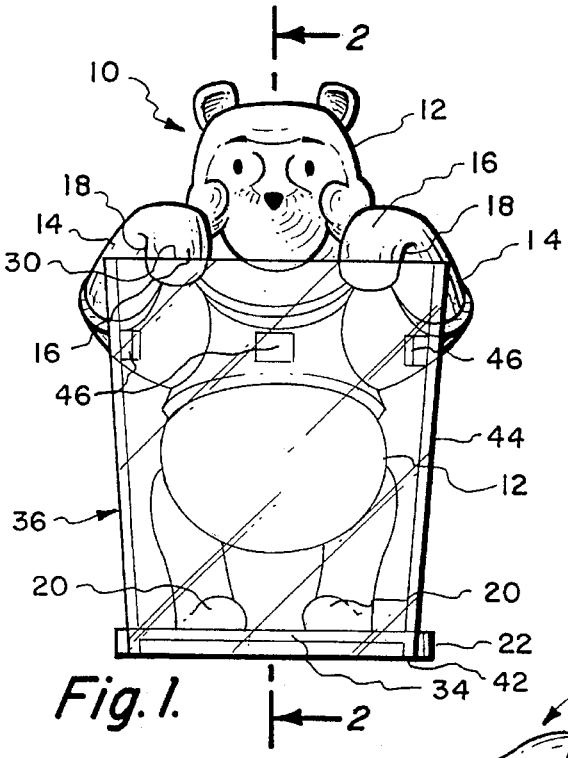
FIG. 1 is a front view of the figurine cup holder of the present invention showing a transparent cup positioned in front of the figurine.

Referring particularly to the drawings, there is shown a cup holder 10 of this invention. Cup holder 10 includes a figurine 12 which has a pair of appendages 14 which comprise arms. The outer end of each appendage 14 is formed into a hand 16. Each hand 16 is downwardly turned which thereby forms a hook member with respect to the remaining portion of the appendage 14. Because of the downwardly turning of each of the hands 16, there is formed a hook engaging pocket 18. The feet 20 of the figurine 12 are fixedly mounted on a base 22. Base 22 is planar and is basically circular in configuration. Included within the base 22 is a lock hole 24. A separate straw hole 26 is also formed within the base 22. The bottom surface of the base 22 includes an enlarged circular recess 28.

Figure 2:
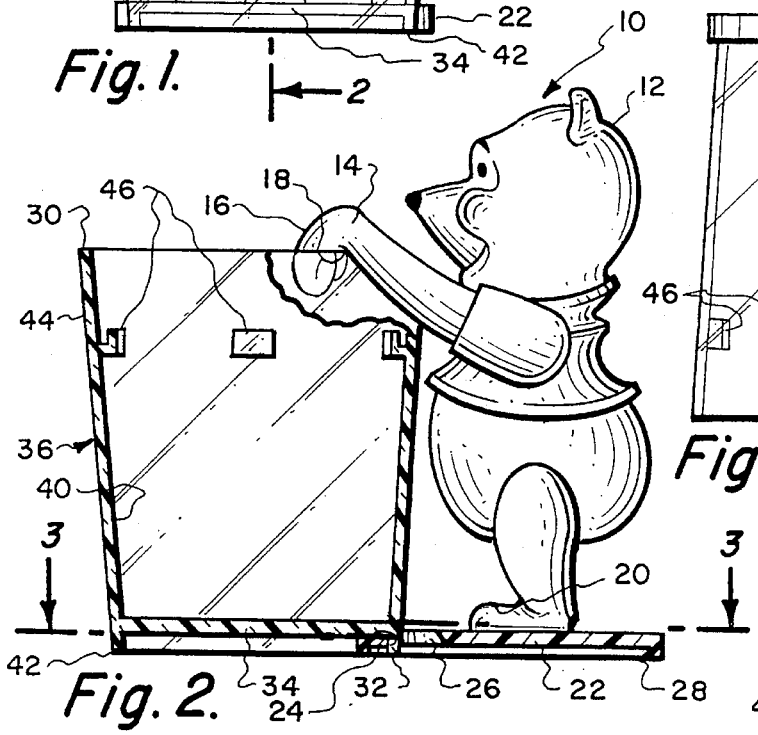
FIG. 2 is a cross-sectional view through the cup holder of the present invention taken along line 2—2 of FIG. 1.
Figure 3:
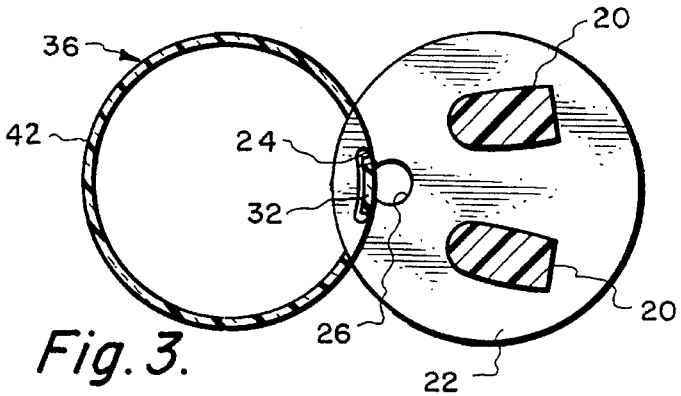
FIG. 3 is a top, plan view through the bottom of the cup and along the base of the figurine, partially in cross-section, taken along line 3—3 of FIG. 2.
Figure 8:
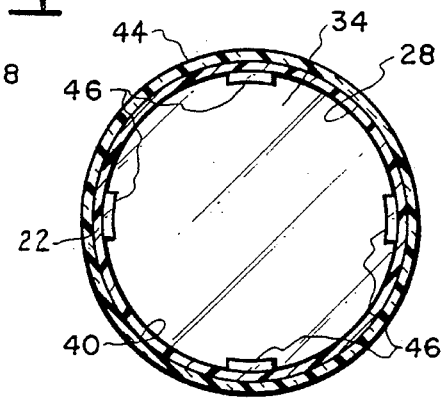
FIG. 8 is a cross-sectional view taken along line 8—8 of FIG. 7.

Pocket 18 of each of the hands 16 is to be connectable with the circular rim 30 as shown in FIGS. 1 and 2 of the drawings. The base 22 is capable of deflecting slightly as does also the figurine 12 as both base 22 and figurine 12 are made of plastic. This deflection is so that a protuberance 32, as shown in FIG. 3, located in the annular flange 42 directly adjacent the bottom wall 34 of the cup 36 is then to be caused to engage with the lock hole 24. This thereby locks in position the figurine 12 with the cup 36 and permits the figurine 12 to be used as a handle by a human in order to affect tipping of the cup to pour the liquid 38 contained within the interior compartment 40 of the cup 36.

Figure 4:
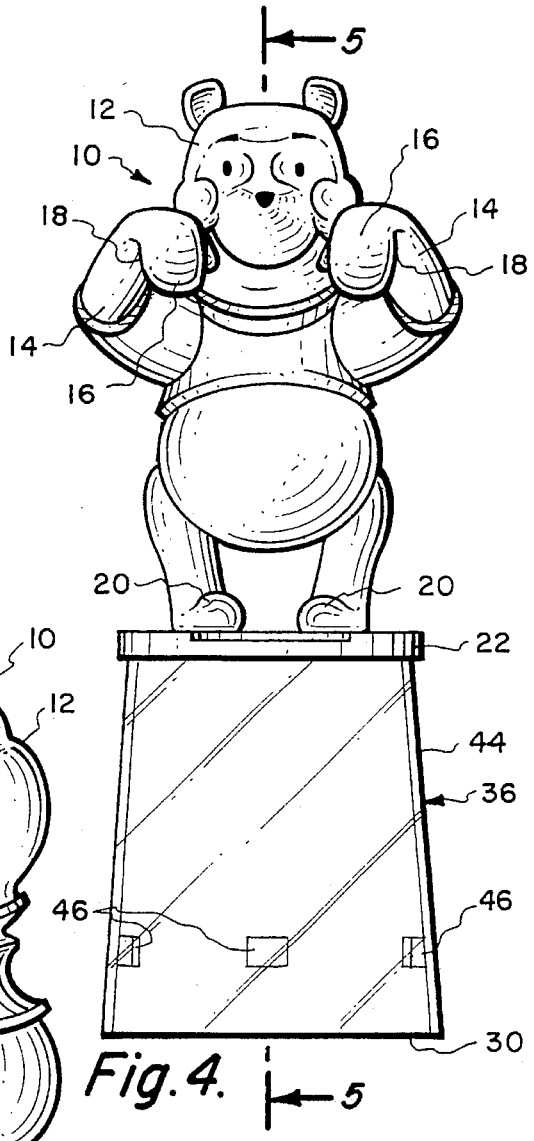
FIG. 4 is a front view of the cup holder of the present invention showing the figurine located in a stacked relationship on the bottom of the cup.
Figure 5:
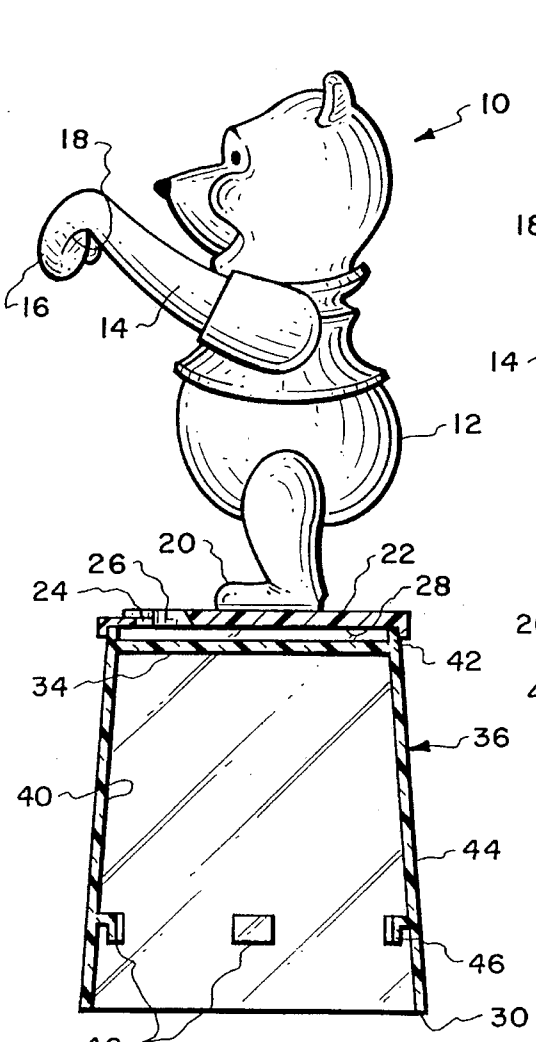
FIG. 5 is a cross-sectional view taken along line 5—5 of FIG. 4.

The human is to be able to manually deflect the figurine 12 and disengage the protuberance 32 from the lock hole 24. This will result in complete separation of the figurine 12 from the cup 36. However, the human can then locate the figurine 12 in a stacked configuration relative to the cup 36. One form of this stacked configuration is shown in FIG. 4 with the cup 36 being turned upside down and the annular flange 42, as shown in FIG. 5, located within the confines of the recess 28. In essence figurine 12 and cup 36 combine to form a trophy-like appearance which normally is attractive in its appearance to children.

The child also has the option of locating the base 22 within the internal compartment 40 with the cup 36 located in an upright position. When the base 22 is located within the internal compartment 40, there is to be formed on the inside surface of the sidewall 44 of the cup 36 a plurality of spaced apart ledge projections 46. The base 22 is to rest on the ledge projections 46 with the upper extending portion of the ledge projections 46 being located within the confines of the recess 28.

Figure 7:
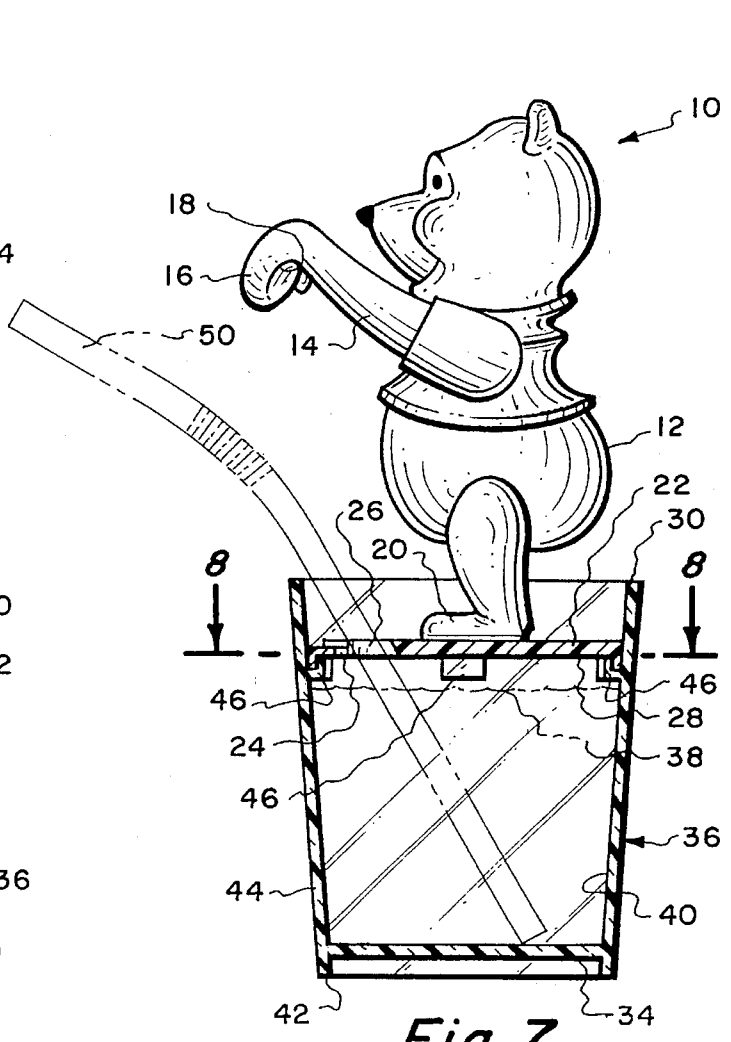
FIG. 7 is a cross-sectional view taken along line 7—7 of FIG. 6 showing a drinking straw being conducted through a hole formed in the base of the figurine that will permit removing of liquid contents contained within the cup.
Figure 6:
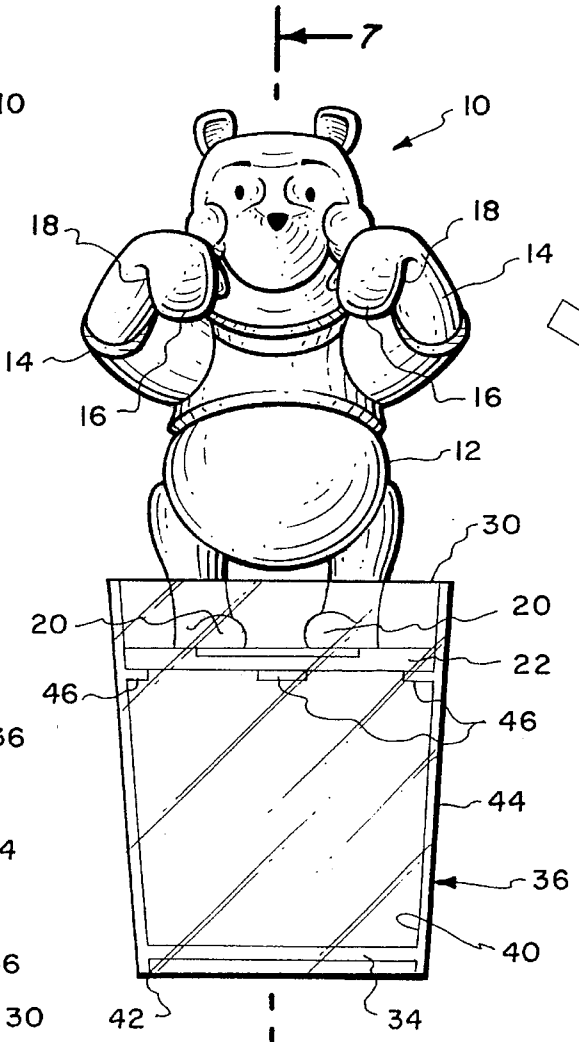
FIG. 6 is a view similar to FIG. 1 but showing the figurine in a stacked relationship on the cup with the base of the figurine being located within the interior of the cup.
Figure 9:
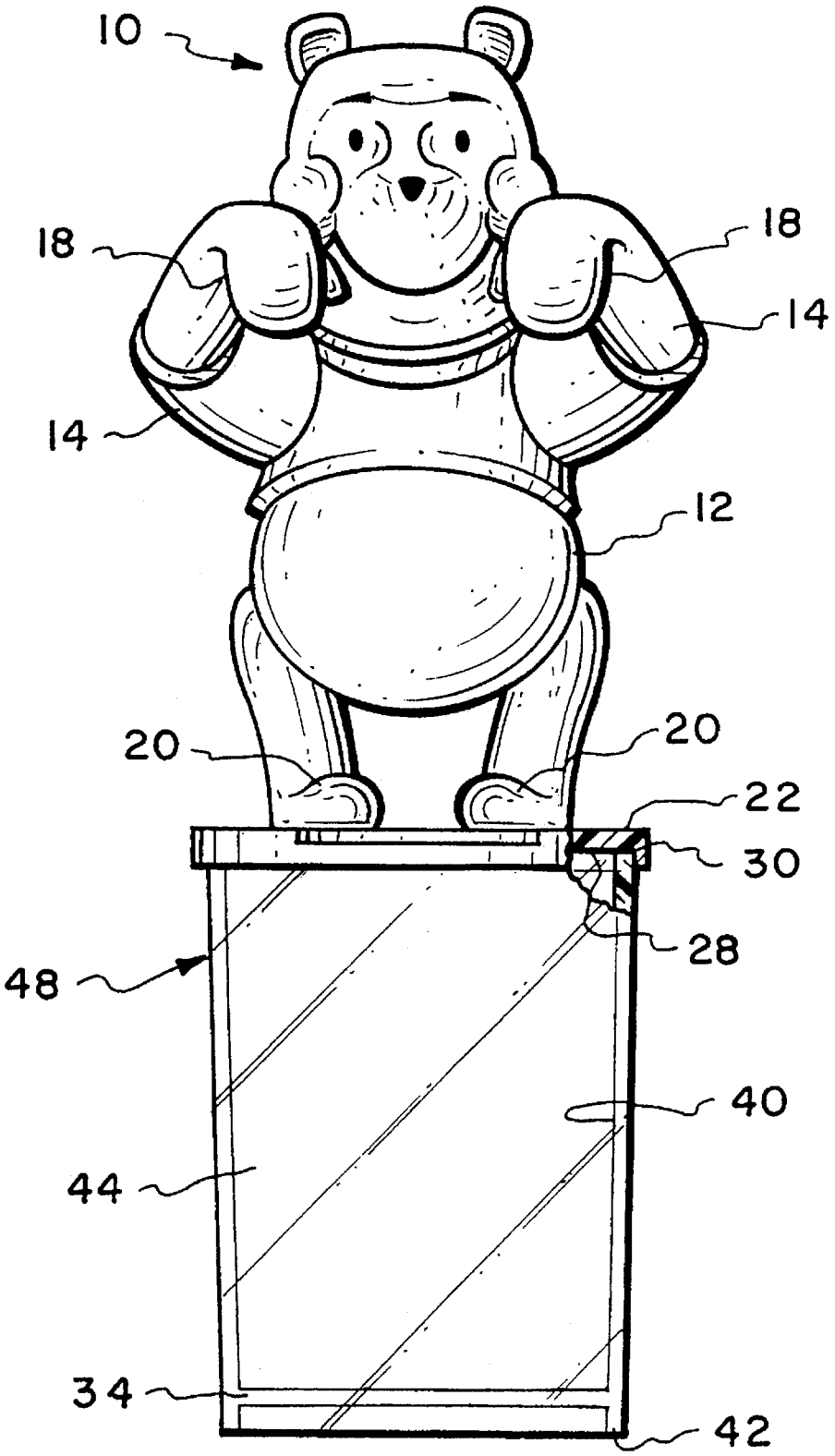
FIG. 9 is a view similar to FIG. 6 but showing the base of the figurine being supported on the rim of the cup as opposed to being supported interiorly of the sidewall of the cup.

Instead of using the ledge projections 46, the cup 48 may be manufactured to be of a size so that the rim 30 will just fit within the recess 28 as is shown in FIG. 9 of the drawings. It is to be understood that when the figurine 12 is positioned as shown in FIGS. 6, 7 and 9 of the drawings, that the human may insert a drinking straw 50 through the straw hole 26 and consume the liquid 38 by means of the straw 50.

It is to be understood that the cup holder 10 and figurine 12 is to be capable of being movable back and forth from a stacked position, shown in FIGS. 4–7 and 9, to the cup holding position shown in FIGS. 1 and 2.

What is claimed is:

1. A cup holder comprising:

a base, said base having engagement means;

a figurine mounted on said base, said figurine having a pair of spaced apart appendages located in a spaced relationship from said base, each said appendage having an outer end defining a hook member; and a cup having a sidewall extending between an open top and a closed bottom, an interlocking device mounted on said cup directly adjacent said closed bottom, said cup having a rim circumferencing said open top, said figurine to removably connect in a cup holding position with said cup with said hook members connecting with said rim, said interlocking device connecting with said engagement means thereby permitting said figurine to be used as a handle for said cup.

2. The cup holder as defined in claim 1 wherein:

said engagement means comprising a lock hole, said interlocking device comprising a protuberance, said protuberance to connect with said lock hole.

3. The cup holder as defined in claim 1 wherein:

said figurine being slightly deflectable to disengage said interlocking device from said engagement means.

4. The cup holder as defined in claim 1 wherein:

said sidewall of said cup having an interior wall surface, ledge means mounted on said interior wall surface, said base being connectable with said ledge means locating said figurine interiorly in a stacked position on said cup.

5. The cup holder as defined in claim 1 wherein:

said base including a straw hole, said straw hole permitting entry of a drinking straw to achieve removing of liquid contents contained within said cup when said figurine is located in said stacked relationship on said cup.

6. The cup holder as defined in claim 1 wherein:

said base being connectable with said rim locating said figurine in an exteriorly stacked relationship on said cup.

7. The cup holder as defined in claim 6 wherein:

said base including a straw hole, said straw hole permitting entry of a drinking straw to achieve removing of liquid contents contained within said cup when said figurine is located in said stacked relationship on said cup.

8. The cup holder as defined in claim 1 wherein:

said base being connectable with said closed bottom locating said figurine in a stacked relationship on said cup.

* * * * *